US006914608B2

(12) United States Patent
Vollschwitz

(10) Patent No.: US 6,914,608 B2
(45) Date of Patent: Jul. 5, 2005

(54) SCREEN DISPLAY PROCESSING APPARATUS, SCREEN DISPLAY PROCESSING METHOD AND COMPUTER PROGRAM

(75) Inventor: Alexander Vollschwitz, Stuttgart (DE)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/653,136

(22) Filed: Sep. 3, 2003

(65) Prior Publication Data

US 2004/0107380 A1 Jun. 3, 2004

(30) Foreign Application Priority Data

Sep. 4, 2002 (JP) ..... 2002-259108

(51) Int. Cl.[7] ..... G09G 5/399
(52) U.S. Cl. ..... 345/539; 345/556; 715/766
(58) Field of Search ..... 345/418, 501, 345/536, 539, 556, 619; 715/764, 766, 768

(56) References Cited

U.S. PATENT DOCUMENTS 5,850,232 A * 12/1998 Engstrom et al. ..... 345/539
6,075,543 A * 6/2000 Akeley ..... 345/539
6,542,154 B1 * 4/2003 Knittel ..... 345/427

* cited by examiner

*Primary Examiner*—Kee M. Tung
(74) *Attorney, Agent, or Firm*—Oblon, Spivak, McClelland, Maier & Neustadt, P.C.

(57) ABSTRACT

In order to efficiently conduct the display processing of a GUI screen by suppressing the drawing of unnecessary objects, the objects are, first, searched from the front toward the rear according to a reverse painter's algorithm while tracing a z-order for processing the drawing. In this step, flags necessary for the drawing may be raised instead of drawing the objects, and a z-buffer needs not be provided. The objects can be really drawn from the rear toward the front according to a painter's algorithm.

17 Claims, 7 Drawing Sheets

SCREEN DISPLAY PROCESSING APPARATUS, SCREEN DISPLAY PROCESSING METHOD AND COMPUTER PROGRAM

BACKGROUND OF THE INVENTION

1. Field of the Invention

The present invention relates to a screen display processing apparatus for processing the display of a screen on a computer, to a screen display processing method and to a computer program. More particularly, the invention relates to a screen display processing apparatus for processing the display of a computer screen constituted by a plurality of objects, to a screen display processing method and to a computer program.

More specifically, the invention relates to a screen display processing apparatus for processing the display of a GUI screen constituted by a plurality of objects and successively updated together with the user interaction, to a screen display processing method and to a computer program, and particularly to a screen display processing apparatus for efficiently processing the display of a GUI screen by suppressing the drawing of unnecessary objects, to a screen display processing method and to a computer program.

2. Description of Related Art

Accompanying the technical innovation in recent years, general purpose computer systems which are relatively small in size, low at cost, featuring high additional values and high functions, called work stations (WSs) and personal computers (PCs), have been developed, placed in the market, and are deeply infiltrating into universities, research institutions, enterprises, offices, and even into everyday life in general households. Nowadays, most of the daily businesses involve computers, and many people spend a day touching the keyboard and the mouse.

In general, a computer system is driven in response to a user input command and displays the processed results on a display screen (interactive type) to offer an interactive processing environment. Recently, the user input environment of the character base or "CUI (character user interface)" through a traditional keyboard as represented by the DOS (disk operating system) shell screen, is shifting toward the "GUI (graphical user interface)" which realizes the graphic base user input. Under the GUI environment, there are provided a desktop simulating a computer system and a number of icons on a display screen.

On the desktop on which the GUI is provided, resource objects handled on a computer system such as files are all expressed as icons. By using a user input device such as a mouse, the user directly applies (e.g., clicks or drags and drops) an operation to an object displayed on the screen, such as an icon symbolizing a program, a data, a folder or a device on the display screen to operate the computer intuitively and in an easy manner. On the desktop are further provided buttons such as menu bars and tool boxes for instantaneously calling a variety of functions, i.e., computer processings, making it more intuitive and easy to input the command to the computer.

Upon introducing the GUI environment, the user is allowed to operate the computer to a sufficient degree without having to particularly learn the names of particular commands or how to operate the command, and without having to carry out complex key input. The computer further is capable of incorporating a user input faithful to the user's will in the system.

Under the GUI environment, the content (appearance) displayed on the desktop screen is updated at all times. For example, the menu window is opened or closed, the buttons are depressed or released, check boxes are selected and excluded, label text and counter value are updated, etc.

Such a change in the GUI screen is usually regarded to be a damage on the screen display and must be restored or redrawn. For example, when a drop-down menu is closed, the region where the menu had been displayed must be recovered again so as to produce a display as covered with the menu. Or, when a check box is clicked though it had not been selected by the user, the displayed content must be updated from the display of screen that is not selected to the selected display of screen.

In order to restore the damage on the two-dimensional GUI screen as described above, there has been widely employed a method of restoring or redrawing all objects in the damaged region from the rear side toward the front. Namely, the rear farthest object such as background image is drawn, first. Then, front objects closer thereto are successively drawn and, finally, the object which is at the most front is drawn. This method has been known as "painter's algorithm" since the GUI screen is drawn in the same manner as when a painter draws a picture on a canvas. The painter draws, first, the sky and mountains at the back, then, draws trees, houses, etc., and, finally, draws portraits of men at the most front. According to this method, the damage in the damaged region can be reliably restored. In practice, however, the region must be redrawn over the areas several times as wide as the damaged region, driving up the cost of calculation.

For example, when there is a change in the color displaying the button disposed in front of a given image, the region closed with this button is a damaged region which must be restored. In this case, the image portion intersecting the damaged region is redrawn, first, and, then, the button on the above region is redrawn.

Here, if the damaged region is completely smeared out with the button, the button only needs be redrawn for restoring the screen display. This overhead can be accepted in the two-dimensional GUI where the content to be changed is not tremendous and only a small number of objects are overlapped. In the two-and-a-half-dimensional GUI where the zoom and animation functions are added to the two-dimensional display, however, there are displayed a considerable amount of damage and the overlapping of objects, and the overhead readily spreads to a problem of performance of the system.

Here, restoration of the screen of the animation GUI will be considered with reference to FIG. 10. In the illustrated example, a given GUI object is moving from the object boundary box of the previous time surrounding the object to a current object boundary box at an animation step.

A restoration processing for the moving object is basically constituted by two simple animation steps. That is, the drawing processing must be executed at a new position to where the object has moved while the initial position must be smeared with the background image (see FIG. 11). The processing for restoring the damage is executed for every step.

As a general method to substitute for the "painter's algorithm", there can be exemplified a "z-buffer algorithm". This algorithm manages the so-called z-buffer to maintain the z-order, i.e., to maintain the order of objects in the previous draw processing. That is, whenever the draw processing is executed at a given position, the z-buffer is checked, first, and it is judged whether the draw processing has been completed already at the above position. When the previous draw processing exists in front of the current draw processing on the z-order, the content of the current draw processing is discarded. This algorithm requires additional checking but can omit the draw processing and, hence, features performance which is still better than that of the painter's algorithm. With the z-buffer algorithm, it is judged at all times whether a given region is smeared out already in front or what the z-order is. Therefore, there is no need of drawing the object according to a predetermined order.

As compared to the painter's algorithm, the z-buffer algorithm has a defect in that it requires an additional memory for the z-buffer. Therefore, this application is unrealistic for the apparatus that has a limitation on the memory. Further, this algorithm is applied to a three-dimensional GUI which operates on a system having high performance such as executing the draw processing in a unit of the pixel. That is, as for the recent draw processing, the z-buffer contains the data related to the z-order for each of the pixels. When the drawing is to be processed maintaining such a fine resolution, the z-buffer checking is virtually impossible on a system having a relatively small calculation ability. Besides, since no particular order has been specified for drawing the GUI objects, there still exists a probability of effecting the unnecessary drawing as described above.

As another method of updating the display of the GUI screen, there can be exemplified a reverse painter's algorithm which is constituted by a combination of the painter's algorithm and the z-buffer algorithm. This method is, generally, the same as the z-buffer algorithm, according to which, however, the GUI objects must be drawn in order opposite to that of the z-order, i.e., from the front side toward the rear side. Though this avoids the unnecessary draw processing, the z-buffer still have to bear a large burden of memory overhead.

SUMMARY OF THE INVENTION

An object of this invention is to provide an excellent screen display processing apparatus capable of favorably processing the display of a GUI screen constituted by a plurality of objects and successively updated together with the user interaction, a screen display processing method and a computer program.

Another object of the invention is to provide an excellent screen display processing apparatus for efficiently processing the display of a GUI screen by suppressing the drawing of unnecessary objects, a screen display processing method and a computer program.

According to one aspect of the invention, there is provided a screen display processing apparatus or a screen display processing method for processing the display of a screen constituted by a plurality of objects by utilizing a front buffer for writing the screen image for producing the screen display and a back buffer for building the image displayed on the screen, comprising:

checking means or step for determining a damaged region that must be repaired accompanying a change in the screen;

forming means or step for determining the object that must be redrawn based on the damaged region found by said checking means or step;

drawing means or step for drawing the object determined to be redrawn by said forming means or step from the rear side toward the front on said back buffer; and screen-updating means or step for restoring the damage by reproducing all damaged regions from the back buffer to the front buffer, except the regions discarded by said forming means or step.

Here, the checking means or step may check the objects from the front toward the rear side according to a z-order, and may pick up a minimal rectangle completely including the object that has changed as a damaged region.

The checking means or step may integrate the damaged regions together. Upon integrating the damaged regions, it is allowed to reduce unnecessary drawing or the updating of the screen display.

The checking means or step integrates the damaged regions together when a region where the two intersecting damaged regions are overlapped one upon the other becomes greater than a region which is added up by integration.

When the region added up by integration becomes greater than the region where the damaged regions are overlapped one upon the other, the damaged region obtained by the integration becomes nearly twice as great. As a result, the amount of data transferred from the back buffer to the front buffer becomes greater when the damaged regions are updated after the completion of the image restoration algorithm. When the boundary box of the third object intersects the thus integrated damaged region, then, this boundary box, too, must be put to the drawing processing.

Further, the forming means or step may set a flag which indicates the necessity of drawing for the object in the damaged region intersecting the preceding object. In this case, the drawing means or step may draw, on the back buffer, all GUI objects to which are set the flags indicating the necessary of the draw processing.

Further, the forming means or step may set a flag which indicates the necessity of drawing for the object in the damaged region that has not been completely covered by the preceding object. In this case, the drawing means or step may draw, on the back buffer, all GUI objects to which are set the flags indicating the necessary of the draw processing.

When an object is completely opaque and its boundary box is completely including the damaged region, the forming means or step may set a flag which indicates that the damaged region has been smeared out after having confirmed that the object is covering the damaged region.

In the damaged region that is smeared out, there is no need of checking whether the remaining objects are intersecting. Since the objects are checked from the front toward the rear side, the object that is judged to be intersecting the damaged region after setting the flag of smear out is inevitably covered with the object that smears out the damaged region. Upon omitting the draw processing, the total amount of the draw processing can be decreased over the whole screen.

Further, the forming means or step may discard both the object and the damaged region when the object is disposed on this side of the damaged region that is to be processed and has not been changed.

The damaged region is completely covered with the objects that are not changing even when the damaged region is constituted by the objects that have changed. Therefore, the change does not appear on the screen, and the draw processing can be omitted.

A second aspect of the present invention is concerned with a computer program described in a form that can be read by a computer to execute, on a computer system, a processing for displaying a screen constituted by a plurality of objects by utilizing a front buffer for writing the screen image for producing the screen display and a back buffer for building the image displayed on the screen, comprising:

a checking step for determining a damaged region that must be repaired accompanying a change in the screen;

a forming step for determining the object that must be redrawn based on the damaged region found by said checking step;

a drawing step for drawing the object determined to be redrawn by said forming step from the rear side toward the front on said back buffer; and a screen-updating step for restoring the damage by reproducing all damaged regions from the back buffer to the front buffer, except the regions discarded by said forming step.

The computer program according to the second aspect of the invention is the one defining the computer program described in a form that can be read by a computer to realize a predetermined processing on a computer system. In other words, the computer program according to the second aspect of the present invention is installed on a computer system, whereby the cooperative action is exhibited on the computer system to obtain the action and effect same as those of the screen display processing apparatus or the screen display processing method according to the first aspect of the present invention.

Other objects, features and advantages of the invention will become obvious from the detailed description of the embodiment of the invention described below and the accompanying drawings.

DESCRIPTION OF PREFERRED EMBODIMENTS

Embodiments of the present invention will now be described with reference to the drawings.

The screen display processing method according to the invention can be preferably applied to a processing for drawing a computer screen for offering a two-dimensional or a two-and-a-half-dimensional GUI environment. The two-and-a-half-dimensional GUI screen referred to here stands for the two-dimensional GUI screen equipped with zoom and animation functions.

Figure 1:
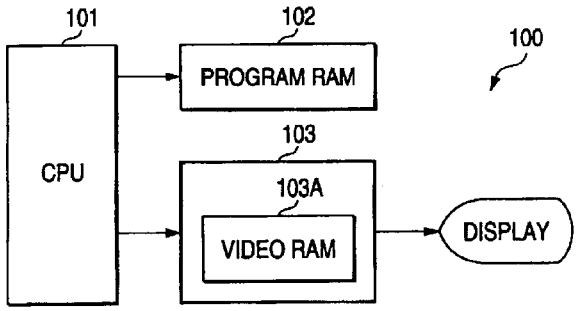
FIG. 1 is a diagram schematically illustrating a minimum degree of hardware constitution with which a screen display processing apparatus 100 of the invention is provided.

FIG. 1 schematically illustrates the hardware constitution of a minimum degree with which is provided a screen display processing apparatus 100 to which the present invention is applied.

In FIG. 1, the screen display processing apparatus 100 includes a CPU (central processing unit) 101, a program RAM (random access memory) 102 and a graphic hardware 103. The CPU 101 is connected to the hardware constituent elements constituting the apparatus 100 through a bus (not shown) which is a common signal transmission line.

The CPU (central processing unit) 101 which is a main controller executes a variety of applications being controlled by an operating system (OS). In this embodiment, the operating system is provided with a bit map display function, and is offering a two-dimensional or a two-and-a-half-dimensional GUI environment.

The program RAM 102 is constituted by, for example, a plurality of DRAMs (dynamic RAMs), and is used for loading a program code executed by the CPU 101 and for temporarily storing the operation data of an execution program.

The graphic hardware 103 is a dedicated controller for actually processing a drawing instruction issued by the CPU 101, and is provided in the apparatus 100 in the form of, for example, an adapter card. To the graphic hardware 103 is connected a display (not shown) such as CRT (cathode-ray tube) or LCD (liquid crystal display) as a target to which the display output. In this embodiment, the display is supporting the bit map display function.

On the graphic hardware 103 as shown, there is mounted a video RAM 103A used as a frame buffer for temporarily writing the content of display on the screen. Instead of an independent hardware that is shown, the video RAM 103A may be in the form of a share memory mapped on the memory space of the program RAM 102.

Though not shown, the screen display processing apparatus 100 may be furnished with a user input device such as a keyboard or a mouse, an external storage unit such as a hard disk unit or a CD/DVD read/write device, a network interface (NIC) for connecting the apparatus 100 to a network, etc., in addition to the above-mentioned units.

A representative example of the screen display processing apparatus 100 may be a computer system for offering a GUI environment, such as a personal computer (PC) and the like.

Under the GUI environment, there are provided a desktop simulating a computer system and a number of icons on a display screen. On the desktop on which the GUI is provided, resource objects on a computer system such as files are all expressed as icons. By using a user input device such as a mouse, the user directly applies (e.g., clicks or drags and drops) an operation to an object displayed on the screen, such as an icon symbolizing a program, a data, a folder or a device on the display screen to operate the computer intuitively and in an easy manner. On the desktop are further provided buttons such as menu bars and tool boxes for instantaneously calling a variety of functions, i.e., computer processings.

The GUI object is constituting a hierarchical tree structure which is stored on the program RAM 102. The CPU 101 makes a read/write access to the program RAM 102.

In this embodiment, the frame buffer is constituted by the "front buffer" and the "back buffer" which are for rendering the GUI objects.

The front buffer is always holding a GUI image which the user uses for producing a display on the screen. The back buffer, on the other hand, is used for building an image that is to be displayed on the screen. That is, while the GUI object is being rendered, the graphic display thereof is, first, built up on the back buffer and is reproduced onto the front buffer after it is completed.

The front buffer is the data itself for producing the screen, and exists on the video RAM 103A. The back buffer may be assigned to either the video RAM 103A or the program RAM 102. In the hardware constitution shown in FIG. 1, the CPU 101 makes at least a write access to the video RAM 103A.

Figure 2:
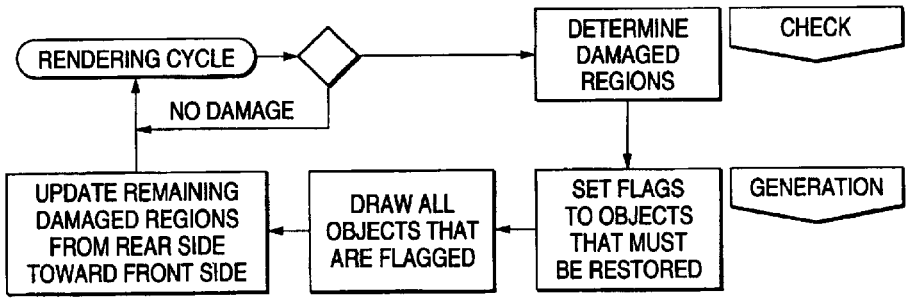
FIG. 2 is a diagram schematically illustrating the constitution of a screen display processing algorithm according to an embodiment of the invention.

FIG. 2 schematically illustrates the constitution of a screen display process algorithm according to the embodiment of the present invention.

The screen display processing starts in response to the occurrence of damage on the GUI screen in the rendering cycle, i.e., in response to a change in the GUI image that must be restored (redrawn), such as when a drop-down menu is closed or when a region displaying the menu must be so recovered as to display as covered with the menu.

Figure 3:
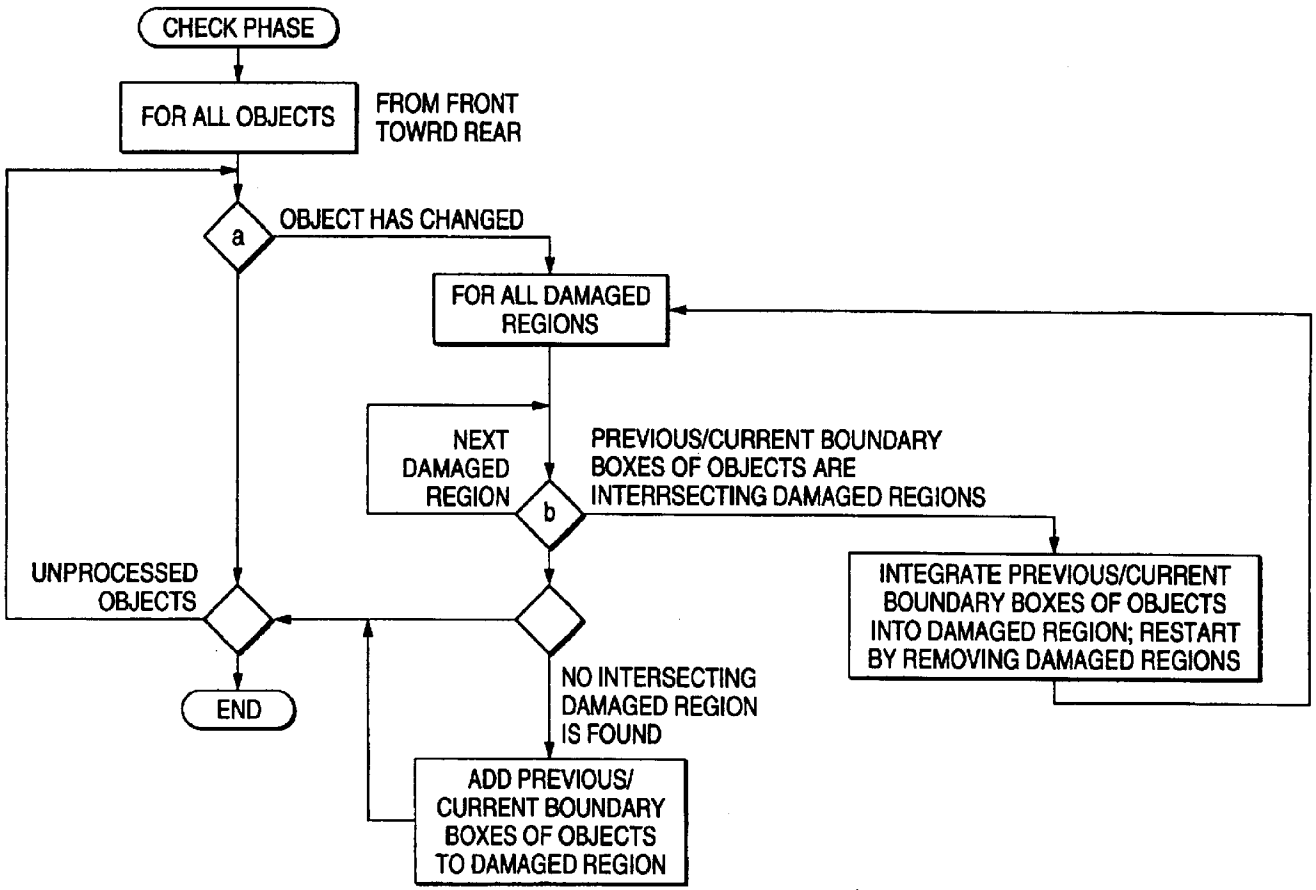
FIG. 3 is a diagram illustrating a detailed procedure of processing in a screen display processing algorithm check phase according to the embodiment of the invention.

A first processing phase determines a GUI region that must be restored, i.e., determines a region called "damaged region". This processing phase is hereinafter called "check phase" and its detailed procedure of processing is illustrated in FIG. 3.

Figure 4:
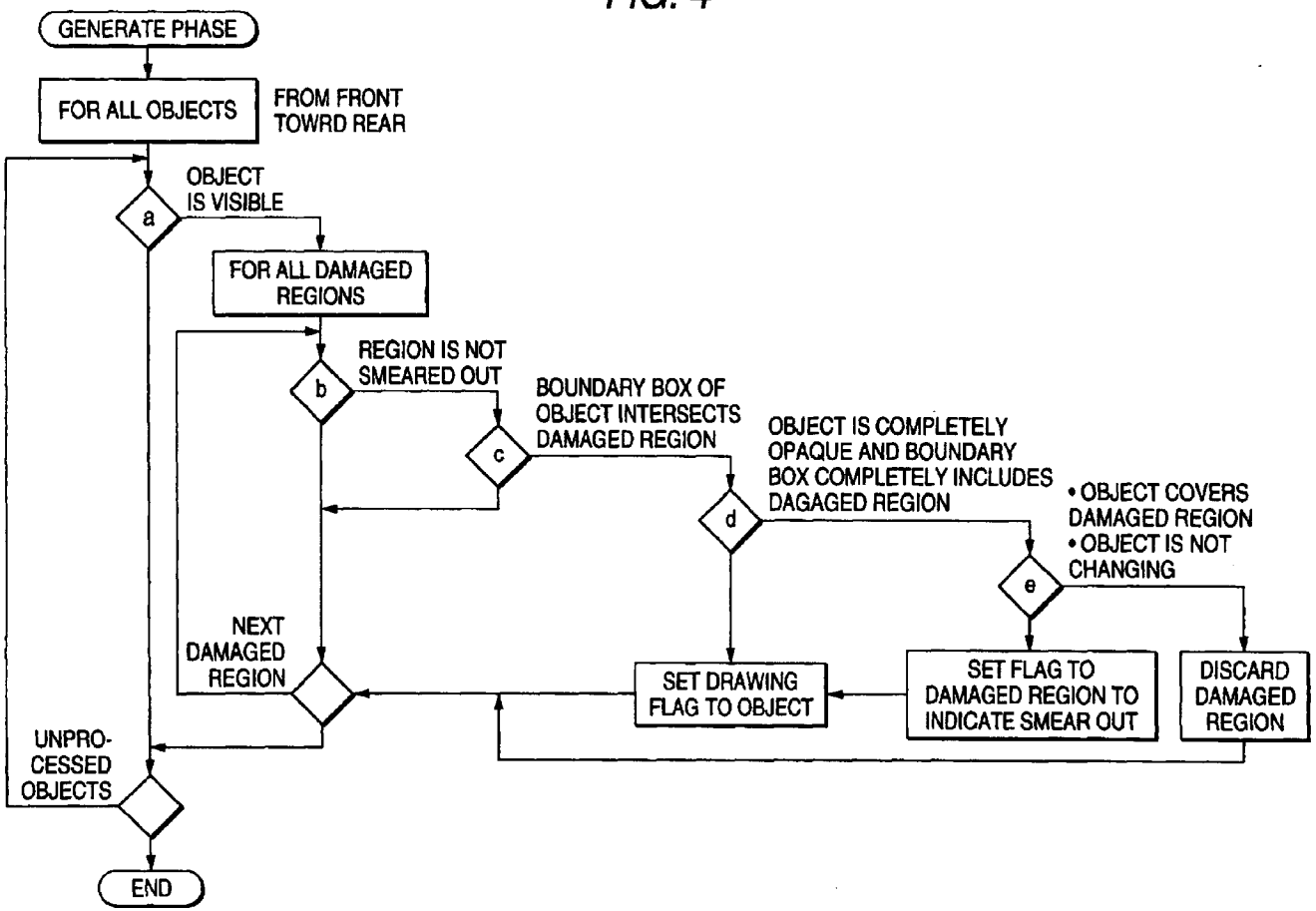
FIG. 4 is a diagram illustrating a detailed procedure of processing in a screen display processing algorithm generate phase according to the embodiment of the invention.

A succeeding second processing phase determines an object that must be restored based on the damaged region found in the check phase, and sets a flag thereon. This processing phase is hereinafter called "generate phase" and its detailed procedure of processing is illustrated in FIG. 4.

A succeeding third processing phase draws, on the back buffer, all GUI objects to which are set flags in the generate phase. Here, the objects are drawn from the rear side toward the front. This processing phase is called "paint phase".

A succeeding fourth processing phase finishes the restoration of damage by reproducing all damaged regions from the back buffer onto the front buffer. Here, the damaged regions are reproduced by excluding the regions discarded in the generate phase. This processing phase is called "update phase".

The second processing phase checks all of the GUI objects whether they intersect all of the damaged regions that are found. The GUI objects are then checked again from the front side toward the rear side according to the z-order.

FIG. 3 illustrates the detailed processing procedure in the check phase which is the second processing phase.

The damaged regions are determined by checking all of the GUI objects that have changed. Here, however, the objects are checked from the front side toward the rear side according to the z-order.

Figure 5:
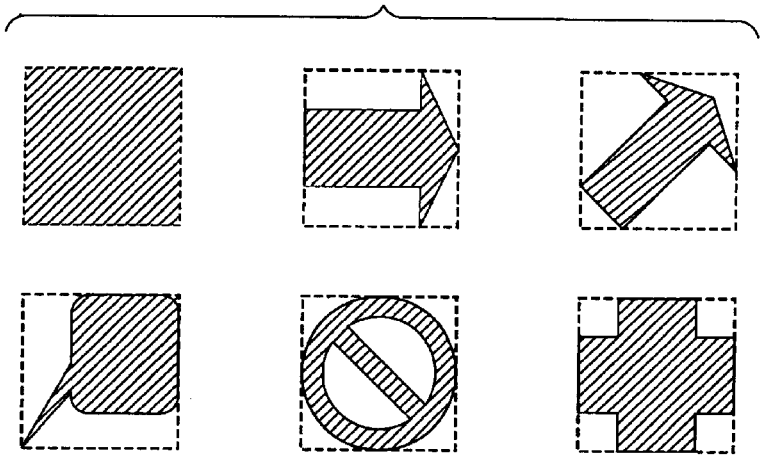
FIG. 5 is a diagram illustrating examples of boundary boxes related to GUI objects of various shapes.
Figure 10:
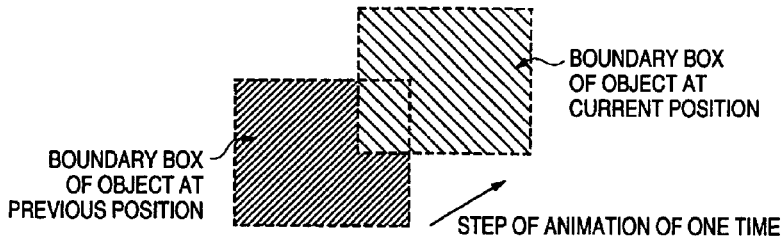
FIG. 10 is a diagram illustrating a processing procedure (prior art) for restoring the screen in the animation GUI.
Figure 11:
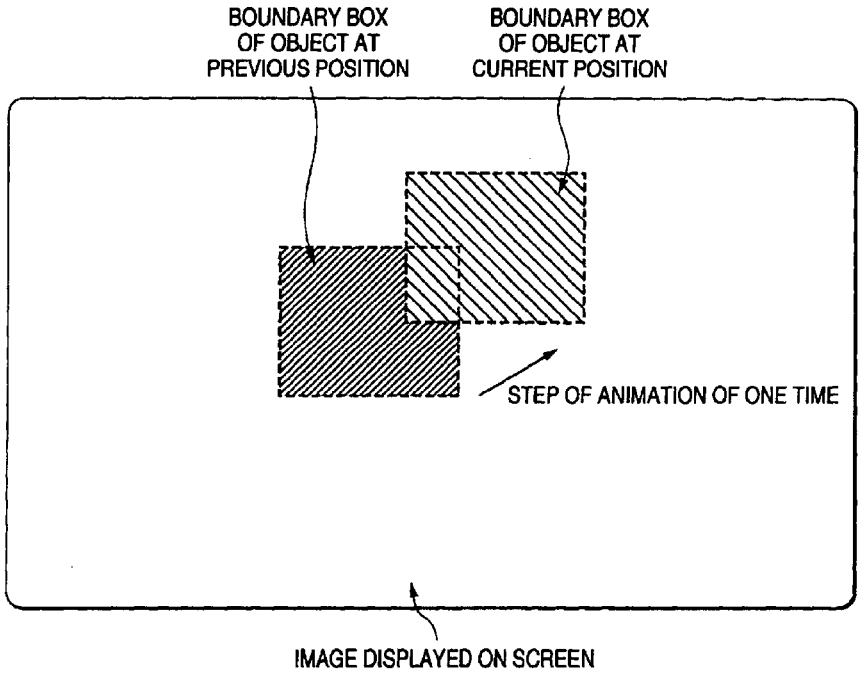
FIG. 11 is a diagram illustrating a processing procedure (prior art) for restoring the screen in the animation GUI.

When there are found the objects that have changed (judging block a), a boundary box of before the change (previous) and a boundary box of after the change (current) become damage regions (see FIG. 11). Here, the boundary box after the change is the one of the current object, and the boundary box of before the change is the one of the object that is drawn last (see FIG. 10). The boundary box completely includes the above object, and the smallest rectangle of which the position is aligned in the horizontal direction becomes the damaged region. FIG. 5 illustrates the boundary boxes related to the GUI objects of various shapes. The damages are processed within the damaged regions.

Next, all damaged regions are integrated. If two damaged regions are intersecting by more than a predetermined degree, they are integrated into one damaged region (judging block b). Namely, it is judged whether the previous or current boundary box of the object is intersecting the damaged region. When it is intersecting, the previous or current boundary box of the object is integrated into the damaged region. Then, the damaged region is removed to restart the process as the integrated region. Upon integrating the damaged regions, it is allowed to reduce unnecessary drawing and the processing for updating the display of screen.

Figure 6:
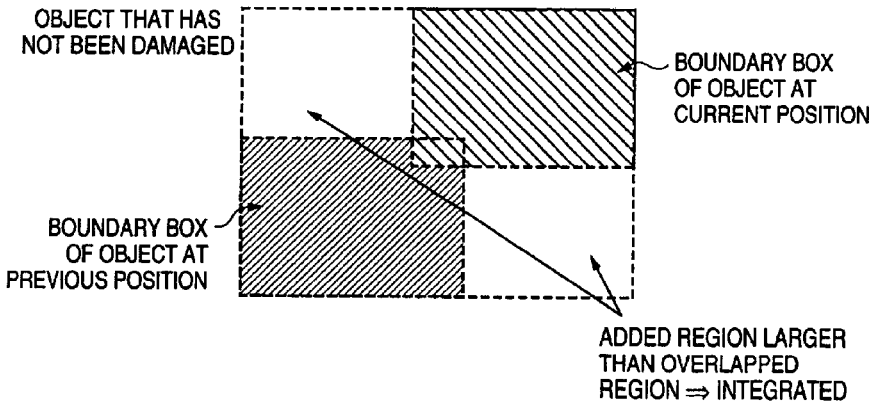
FIG. 6 is a diagram illustrating a processing for integrating the damaged regions together.

When the region added up by the integration becomes greater than the region where the damaged regions are overlapped one upon another as shown in, for example, FIG. 6, the damaged region obtained by the integration thereof becomes nearly twice as great. As a result, when the damaged region is updated accompanying the completion of the image restoration algorithm, the data are transferred in an increased amount from the back buffer to the front buffer. Further, when the boundary box of the third object intersects the thus integrated damaged region, the boundary box, too, must be put to the draw processing. In such a case, therefore, it is efficient to separately process the two damaged regions and, hence, the damaged regions are not integrated together.

Figure 7:
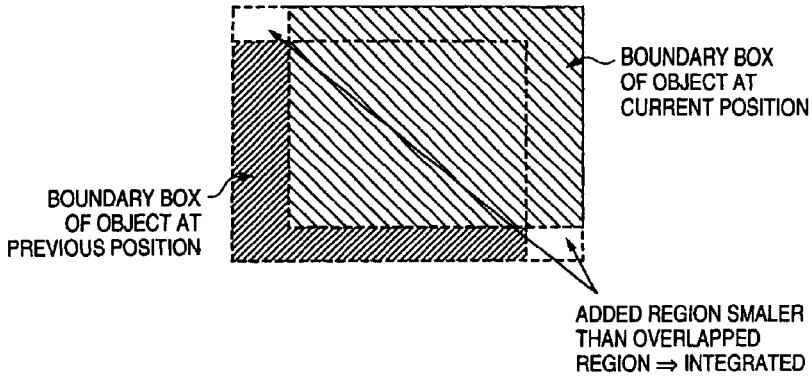
FIG. 7 is a diagram illustrating a processing for integrating the damaged regions together.

When the sum of the two damaged regions is greater than the integrated damaged region, on the other hand, it is rather disadvantageous to handle the damaged region that has been integrated already as the two separate damaged regions if the region where the two intersecting damaged regions are overlapped one upon another becomes greater than the region added up by integration (see FIG. 7). The threshold value for judging whether the intersecting damaged regions be integrated together, serves as a parameter in the algorithm.

To determine the damaged region, the GUI objects are checked from the front side toward the rear side according to the z-order. The object at the most front has a level 0 on the z-order. The level number increases one by one for every object toward the rear side. When the damaged region is discovered, the levels of the related GUI objects on the z-order are assigned to the damaged region. For example, when there is a change in the third object from the most front, the level 2 on the z-order is assigned onto the damaged region that is taken out as a result. Further, when the two damaged regions are integrated together, the lower level between those of the two damaged regions on the z-order is assigned to the integrated damaged region.

After the damaged regions are all checked as described above, the previous and current boundary boxes of object are added to the list of damaged regions.

When the unprocessed objects are remaining, the next object is taken out, checked for the presence of change, and the processing is repeated in the same manner as described above.

FIG. 4 illustrates a detailed processing procedure of the generate phase which is the third processing phase.

The generate phase checks all of the GUI objects concerning whether they intersect all of the damaged regions found in the above check phase. Here, however, the objects are checked from the front toward the rear side according to the z-order. When it is learned that the object is intersecting a given damaged region, a flag is set to the object to indicate the necessity of draw processing.

All of the GUI objects are checked from the front toward the rear side in regard to whether they are visible on the screen (judging block a).

The visible objects are checked concerning the relationship to all damaged regions. It is further checked whether the objects are smearing out the damaged regions (judging block b). When the objects are not filling the damaged regions, it is then checked whether the boundary box of the object is intersecting the damaged region (judging block c). When the boundary box of the object is not intersecting the damaged regions, it is checked whether the object is completely opaque and whether its boundary box is completely including the damaged region.

Figure 8:
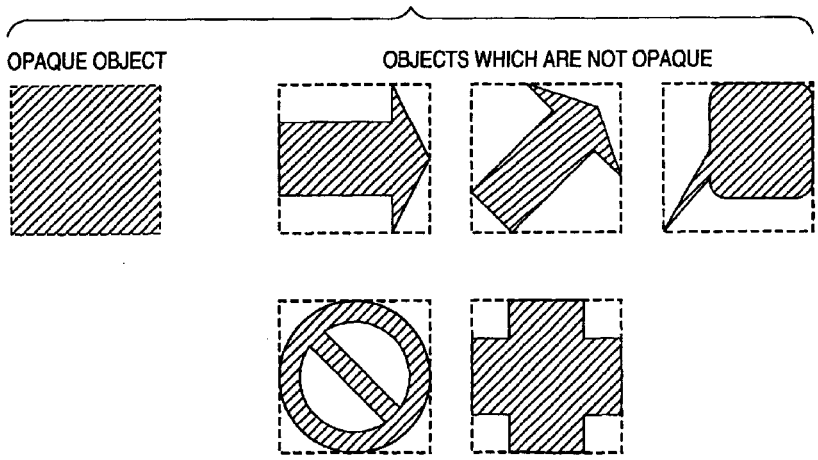
FIG. 8 is a diagram illustrating an opaque object and objects which are not completely opaque.

When the object is completely opaque and its boundary box is completely including the damaged region (judging block d), then, a flag is set to indicate that the damaged region has been smeared out (filled) upon confirming that the object is completely covering the damaged region (i.e., the object is on this side on the z-order and is not changing) (judging block e). In the damaged region that has been smeared out, there is no need of checking whether it is intersecting the remaining objects. FIG. 8 illustrates an opaque object and objects which are not completely opaque.

Since the objects are checked from the front side toward the rear side, the damaged region is inevitably covered with the object that smears out the damaged region when it is judged that the object is intersecting the damaged region after a flag is set thereto to indicate the smearing out. By omitting this draw processing, the total amount of the draw processing can be decreased on the screen as a whole.

When the object has a z-order level lower than the damaged region that is to be processed, i.e., is placed on this side and has not been changed, both the object and the damaged region can be canceled. This is because, even when the damaged region is constituted by the object that has changed, it is completely concealed by the object that has not been changed. In such a case, a change in the object in the damaged region is concealed, and the draw processing can be omitted.

When it is judged at the judging block d that the boundary box is not completely including the damaged region, a flag is set to the object in the damaged region to indicate the necessity of the draw processing.

Figure 9:
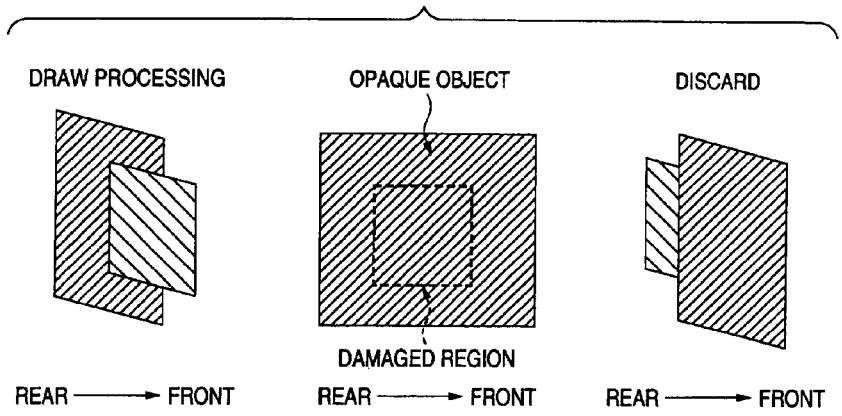
FIG. 9 is a diagram illustrating a standard for judging whether the damaged region be put to the draw processing or be discarded.

FIG. 9 illustrates a standard for judging whether the damaged region be put to the draw processing or discarded. When the object on this side of the damaged region is not completely covering the damaged region, the damaged region must be put to the draw processing. Further, the damaged region covered with an opaque object must be put to the draw processing. The damaged region completely covered with the object on this side needs not be put to the draw processing, and is discarded from the necessity of processing.

The invention was described above in detail with reference to particular embodiments. It will, however, be obvious that the embodiments can be modified or substituted for without departing from the gist of the invention. Namely, the invention is disclosed in the form of examples, and the contents disclosed in the specification shall not be interpreted in a limited sense. To judge the gist of the invention, reference should be made to the column of claims described at the beginning.

According to the present invention as described above, there are provided an excellent screen display processing apparatus capable of processing the display of a GUI screen constituted by a plurality of objects and successively updated together with the user interaction, a screen display processing method and a computer program.

According to the present invention, there are further provided an excellent screen display processing apparatus capable of efficiently processing the display of a GUI screen by suppressing the drawing of unnecessary objects, a screen display processing method and a computer program.

According to the screen display processing apparatus or the screen display processing method of the present invention, it is allowed to reduce the number of draw processings at the time of redrawing the GUI screen.

According to the screen display processing apparatus or the screen display processing method of the present invention, further, it is allowed to reduce the total amount of data transferred from the back buffer to the front buffer at the time of redrawing the GUI screen.

According to the screen display processing apparatus or the screen display processing method of the present invention, further, it is allowed to reduce the memory capacity required in the computer processing for providing a GUI environment.

What is claimed is:

1. A screen display processing apparatus for processing the display of a screen constituted by a plurality of objects, comprising:

a front buffer for writing picture image for producing a picture display;

a back buffer used for building an image to be displayed on the screen;

checking means for determining a damaged region that must be repaired accompanying a change in the screen;

forming means for determining the object that must be redrawn based on the damaged region found by said checking means;

drawing means for drawing the object determined to be redrawn by said forming means from the rear side toward the front on said back buffer; and screen-updating means for restoring the damage by reproducing all damaged regions from the back buffer to the front buffer, except the regions discarded by said forming means.

2. A screen display processing apparatus according to claim 1, wherein said checking means checks the objects from the front toward the rear side according to a z-order, and picks up a minimal rectangle completely including the object that has changed as a damaged region.

3. A screen display processing apparatus according to claim 1, wherein said checking means integrates the damaged regions together.

4. A screen display processing apparatus according to claim 3, wherein said checking means integrates the damaged regions together when a region where the two intersecting damaged regions are overlapped one upon the other becomes greater than a region which is added up by integration.

5. A screen display processing apparatus according to claim 1, wherein:

said forming means sets a flag which indicates the necessity of drawing for the object in the damaged region intersecting the preceding object; and said drawing means draws, on the back buffer, all GUI objects to which is set a flag indicating the necessity of drawing by said forming means.

6. A screen display processing apparatus according to claim 1, wherein:

said forming means sets a flag which indicates the necessity of drawing for the object in the damaged region that has not been completely covered by the preceding object; and said drawing means draws, on the back buffer, all GUI objects to which is set a flag indicating the necessity of drawing by said forming means.

7. A screen display processing apparatus according to claim 1, wherein, when an object is completely opaque and its boundary box is completely including the damaged region, said forming means sets a flag which indicates that the damaged region has been smeared out after having confirmed that the object is covering the damaged region.

8. A screen display processing apparatus according to claim 1, wherein said forming means discards both the object and the damaged region when the object is disposed on this side of the damaged region that is to be processed and has not been changed.

9. A screen display processing method for processing the display of a screen constituted by a plurality of objects by utilizing a front buffer for writing the screen image for producing the screen display and a back buffer for building the image displayed on the screen, comprising:

a checking step for determining a damaged region that must be repaired accompanying a change in the screen;

a forming step for determining the object that must be redrawn based on the damaged region found by said checking step;

a drawing step for drawing the object determined to be redrawn by said forming step from the rear side toward the front on said back buffer; and a screen-updating step for restoring the damage by reproducing all damaged regions from the back buffer to the front buffer, except the regions discarded by said forming step.

10. A screen display processing method according to claim 9, wherein said checking step checks the objects from the front toward the rear side according to a z-order, and picks up a minimal rectangle completely including the object that has changed as a damaged region.

11. A screen display processing method according to claim 9, wherein said checking step integrates the damaged regions together.

12. A screen display processing method according to claim 9, wherein said checking step integrates the damaged regions together when a region where the two intersecting damaged regions are overlapped one upon the other becomes greater than a region which is added up by integration.

13. A screen display processing method according to claim 9, wherein:

said forming step sets a flag which indicates the necessity of drawing for the object in the damaged region intersecting the preceding object; and said drawing step draws, on the back buffer, all GUI objects to which is set a flag indicating the necessity of drawing by said forming step.

14. A screen display processing method according to claim 9, wherein:

said forming step sets a flag which indicates the necessity of drawing for the object in the damaged region that has not been completely covered by the preceding object; and said drawing step draws, on the back buffer, all GUI objects to which is set a flag indicating the necessity of drawing by said forming step.

15. A screen display processing method according to claim 9, wherein, when an object is completely opaque and its boundary box is completely including the damaged region, said forming step sets a flag which indicates that the damaged region has been smeared out after having confirmed that the object is covering the damaged region.

16. A screen display processing method according to claim 9, wherein said forming step discards both the object and the damaged region when the object is disposed on this side of the damaged region that is to be processed and has not been changed.

17. A computer program described in a form that can be read by a computer to execute, on a computer system, a processing for displaying a screen constituted by a plurality of objects by utilizing a front buffer for writing the screen image for producing the screen display output and aback buffer for building the image displayed on the screen, comprising:

a checking step for determining a damaged region that must be repaired accompanying a change in the screen;

a forming step for determining the object that must be redrawn based on the damaged region found by said checking step;

a drawing step for drawing the object determined to be redrawn by said forming step from the rear side toward the front on said back buffer; and a screen-updating step for restoring the damage by reproducing all damaged regions from the back buffer to the front buffer, except the regions discarded by said forming step.

* * * * *